US008447195B2

(12) United States Patent
Motoyama

(10) Patent No.: US 8,447,195 B2
(45) **Date of Patent: *May 21, 2013**

(54) METHODS AND APPARATUS FOR ADJUSTING DEVICE POWER CONSUMPTION BASED ON USAGE DATA

(75) Inventor: Tetsuro Motoyama, San Jose, CA (US)

(73) Assignee: Ricoh Company, Ltd, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/549,854

(22) Filed: Jul. 16, 2012

(65) Prior Publication Data

US 2012/0281995 A1 Nov. 8, 2012

Related U.S. Application Data

(63) Continuation of application No. 13/212,317, filed on Aug. 18, 2011, now Pat. No. 8,249,472, which is a continuation of application No. 12/694,142, filed on Jan. 26, 2010, now Pat. No. 8,023,842.

(51) Int. Cl.
*G03G 15/00* (2006.01)

(52) U.S. Cl.
USPC ..... 399/37; 399/43

(58) Field of Classification Search
USPC ..... 399/37, 70, 43
See application file for complete search history.

(56) References Cited

U.S. PATENT DOCUMENTS 8,023,842 B2 * 9/2011 Motoyama ..... 399/37
8,249,472 B2 * 8/2012 Motoyama ..... 399/37

* cited by examiner

*Primary Examiner* — Susan Lee
(74) *Attorney, Agent, or Firm* — Duft Bornsen & Fettig, LLP

(57) ABSTRACT

Methods and apparatus for adjusting printing device power consumption based on previously acquired usage data. The printing device has multiple energy consumption states including at least a ready state in which the printing device is ready to commence processing of a print job immediately upon receipt and including at least a low power state where the printing device is not ready to commence processing of a newly received print job. Acquired usage data includes parameters of print jobs submitted during a data collection period of time. The parameters may include time and date of submitted print jobs. Based on the usage data a usage profile is determined. The usage profile identifies one or more high usage periods of time and one or more low usage periods of time. Methods and apparatus then switch the printing device among the multiple energy consumption states based on the usage profile.

20 Claims, 8 Drawing Sheets

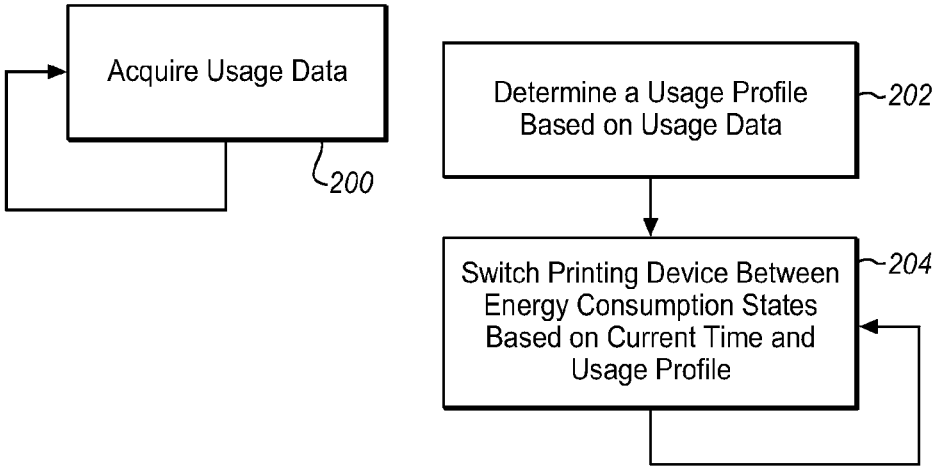
FIG. 2
FIG. 3
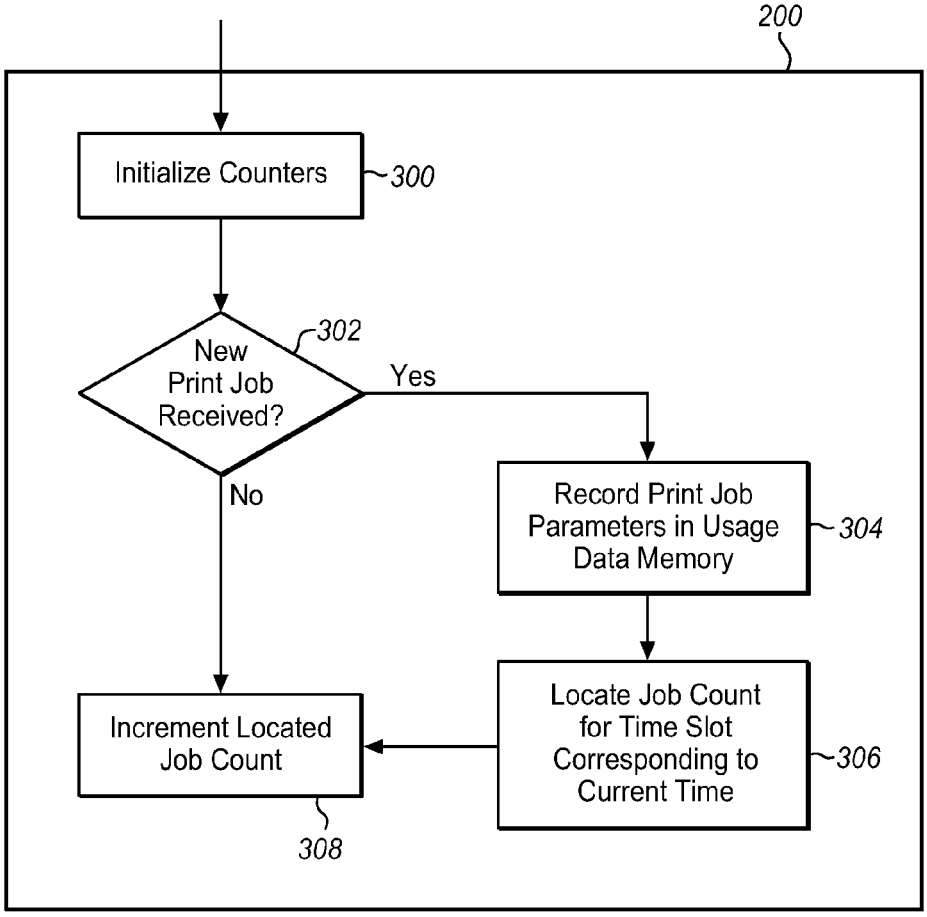

METHODS AND APPARATUS FOR ADJUSTING DEVICE POWER CONSUMPTION BASED ON USAGE DATA

RELATED APPLICATION

This non-provisional patent application is a continuation of U.S. patent application Ser. No. 13/212,317 filed on Aug. 18, 2011, which is a continuation of U.S. patent application Ser. No. 12/694,142 now U.S. Pat. No. 8,023,842 filed on Jan. 26, 2010, both of which are incorporated herein by reference.

BACKGROUND

1. Field of the Invention

The invention relates generally to printing system and more specifically relates to printing systems having multiple energy consumption states and to methods and apparatus for automatically adjusting power consumption based on a usage profile of previous usage of the printing system.

2. Discussion of Related Art

Many printing systems utilize substantial power in operation. For example, electrophotographic (e.g., "laser") printers typically have heated fuser rolls for fusing toner particles to paper and consume significant power. Larger printing systems (e.g., "production printing systems") may utilize substantial power for operating motors involved in moving large volumes of paper through the printing system.

It is generally known in the art to provide power saving modes in such printing systems. As presently practiced, power saving modes are typically invoked in response to detecting a sufficient duration of idle time for the printing system. Sometimes the duration of the idle period may be reconfigured by a user to adapt to a user's requirements. For example, in a power saving mode the heated fuser of an electrophotographic printing system may be turned off or cooled to a lower temperature to conserve power after detecting an idle period of sufficient duration.

Once a printing system enters a power saving mode it can require significant time to bring the printing system back to a full power ready state. For example, re-heating the fuser back to an appropriate temperature for normal operation can require substantial time. The time required to restore a printing system to a ready state from a power saving mode may vary widely depending on the printer but in many cases can be quite substantial.

Though power saving may be important in many environments it can be a significant roadblock to user productivity in that a user may need to print a document quickly but the printing system is in a low power mode and requires substantial startup time to return to a ready mode. In addition to the possible loss of productivity, users can be annoyed by the lengthy delay in waiting for the printing system to return to a ready mode while they are waiting to retrieve a printed document.

The same issues apply to other systems that print documents such as photocopy systems and multi-function devices (e.g., multi-function printers or MFPs). Thus as used herein, "printing system" or "printing device" or simply "printer" refers to any device adapted to generate printed output. The printed output may be generated based on data received from an attached computing system (such as in the case of a computer printer or an MFP device) or may be generated from a scanned digital copy of an original printed document (e.g., as in a photocopier system).

Thus, it is an ongoing challenge to manage power consumption of a printing system while reducing wasted user time and loss of productivity.

SUMMARY

The present invention solves the above and other problems, thereby advancing the state of the useful arts, by providing methods and apparatus for automatically switching a printing device between a plurality of energy consumption states based on a usage profile. In one exemplary embodiment, usage data is acquired comprising the time of day for the start of each of a plurality of print jobs submitted to the printing device during a data collection period of time. The usage profile is determined based on analysis the previously acquired usage data. In one exemplary embodiment, the analysis determines the workload level of each of a plurality of time slots that comprise the data collection period. In one exemplary embodiment, the usage profile associates an energy consumption state with each of the plurality of time slots based on a comparison of the workload level of each time slot with one or more threshold values defining desired energy consumption states. Thus, where a workload is heavier during time slot, the energy consumption state may be switched to a desired state (e.g., a ready state) to permit rapid response to requests to print documents.

A first aspect hereof provides a method operable in a printing device for adjusting power consumption of the printing device where the printing device has multiple energy consumption states. The method includes acquiring usage data regarding a plurality of print jobs submitted to the printing device over a data collection period of time and determining a usage profile from the usage data. The usage profile identifies one or more high usage periods of time and one or more low usage periods of time. The method then automatically switches the printing device between the multiple energy consumption states when the current time approaches a high usage period of time and when the current time approaches a low usage period of time.

Another aspect hereof provides a printing device that includes a printing engine having multiple energy consumption states and a printer controller coupled to printing engine. The printer controller is adapted to determine from previous usage data of the printing device a usage profile. The usage profile identifies one or more high usage periods of time and identifying one or more low usage periods of time. The printer controller is further adapted to switch the printing device between the multiple energy consumption states when the current time approaches a high usage period of time and when the current time approaches a low usage period of time.

Yet another aspect hereof provides a method operable in a printing system for adjusting power consumption of the printing system. The method includes receiving usage data regarding a plurality of print jobs submitted to the printing system over a data collection period of time. The method also includes determining from the usage data a usage profile. The usage profile identifies one or more high usage periods of time and one or more low usage periods of time. The method then switches, based on the usage profile, the printing system to a ready state prior to an identified high usage period of time such that the printing system is ready to process a new print job upon receipt during the high usage period of time. The method also switches, based on the usage profile, the printing system to a low power consumption mode during an identified low usage period of time.

BRIEF DESCRIPTION OF THE DRAWINGS

The same reference number represents the same element or same type of element on all drawings.

FIGS. 2 through 6 are flowcharts describing exemplary methods for providing enhanced energy management of printing devices based on a usage profile derived from previous usage data in accordance with features and aspects hereof.

DETAILED DESCRIPTION OF THE DRAWINGS

FIGS. 1 through 10 and the following description depict specific exemplary embodiments of the present invention to teach those skilled in the art how to make and use the invention. For the purpose of this teaching, some conventional aspects of the invention have been simplified or omitted. Those skilled in the art will appreciate variations from these embodiments that fall within the scope of the present invention. Those skilled in the art will appreciate that the features described below can be combined in various ways to form multiple variations of the present invention. As a result, the invention is not limited to the specific embodiments described below, but only by the claims and their equivalents.

Figure 1:
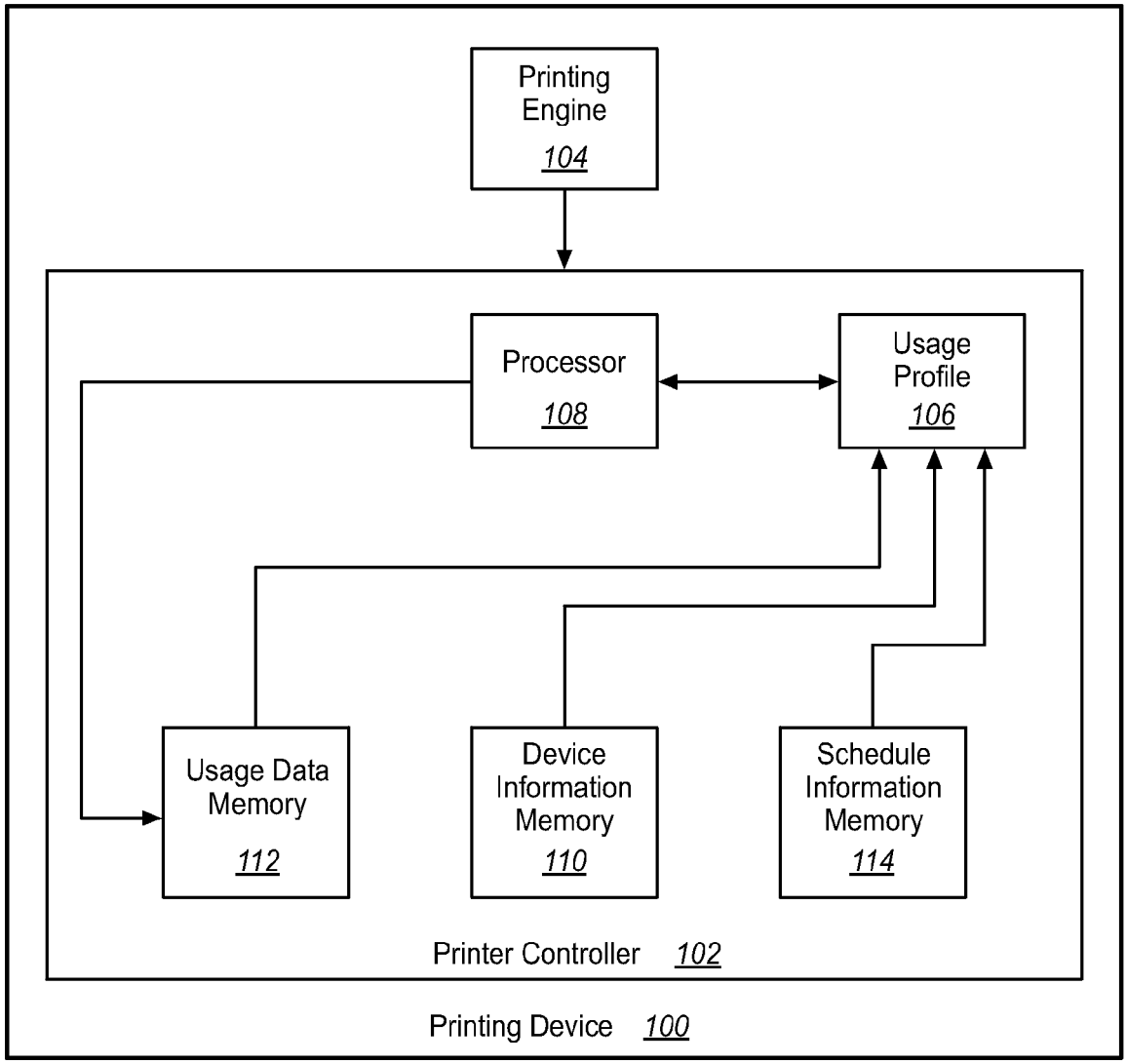
FIG. 1 is a block diagram of an exemplary printing device providing enhanced energy management of the printing device based on a usage profile derived from previous usage data in accordance with features and aspects hereof.

FIG. 1 is a block diagram of an exemplary printing device 100 enhanced in accordance with features and aspects hereof to provide automated switching of the printing device between multiple energy consumption states based on a usage profile determined from previously acquired print job submission history. Printing device 100 includes printer controller 102 coupled with printing engine 104. Printing engine 104 may be any type of printing engine including, for example, electrophotographic (i.e., laser), inkjet, etc. Printing engine 104 has a plurality of energy consumption states including, for example, a ready state and a low-power state. In the ready state, printing engine 104 is ready to immediately start printing document images provided by printer controller 102. In the low-power state, printing engine 104 is not ready to print document images generated by printer controller 102 but rather requires a startup or warm-up period of time to transition to the ready state before it can print images. Or, for example, in the context of inkjet printing technologies, the printing engine 104 may require some period of time to clean the inkjet print heads before it is ready to print.

Printer controller 102 includes processor 108 adapted to control overall operation of printer controller 102. Processor 108 includes suitable circuits for interfacing with printing engine 104 and other components within printer controller 102. Processor 102 generally includes a general or special purpose processor and associated suitable memory for storing programmed instructions and data required for operation of printing device 100. In alternative embodiments, processor 102 may be implemented as suitably designed custom circuits rather than, or in addition to, a programmable general or special purpose processor.

Processor 108 is coupled with usage data memory 112 and adapted to store information regarding print jobs submitted to printing device 100. In one exemplary embodiment, the acquisition of print job information may be continuous as background processing by controller 102. In other exemplary embodiments, acquisition of print job information may proceed for a predetermined data collection period of time such as a number of minutes, hours, days, etc. Print job information stored in usage data memory 112 may include, for example, the current time of day (including day of the week, etc) at the time of submission of the print job and other parameters associated with the print job.

Processor 108 is further adapted to analyze the usage data to determine a usage profile 106. In one exemplary embodiment, processor 108 may incorporate other information into the determination of usage profile 106 in addition to the usage data stored in usage data memory 112. For example, device information memory 110 may store information regarding printing device 100 that may be incorporated into usage profile 106 developed by processor 108. Device information may include, for example, identification information (e.g., make, model, etc.), available energy consumption states, energy consumed in the various states, startup/warm-up time to transition from various states to other states, etc. Schedule information may include work schedules regarding the enterprise in which printing device 100 is utilized (e.g., work days and work hours, holidays, fiscal year dates, etc). Schedule information may also include enterprise related policies regarding usage of printing device 100. For example, a company may employ a policy that allows only particular identified printers of multiple available printing devices to be used during identified periods of identified days. Or, a company may defined a policy that only certain users or groups of users may use a particular printing device during identified periods of time. Another exemplary policy may force one or more printing devices to an idle state (e.g., a low energy consumption state) during the lunch period of all work days.

The usage profile 106 generally relates patterns of historical usage of the printing device 100 to periods of time where the printing device should be in one or another of the multiple energy consumption states. For example, periods of time identified as high usage periods of time are identified in the usage profile as associated with the ready state while periods of time identified as low usage periods of time are associated with the low power state. The relationship may be determined by processor 108 analyzing the usage data in usage data memory 112 and identifying such high and low usage periods of time in the acquired data. In one exemplary embodiment, usage profile 106 may be comprise a memory component in which the usage profile determined by processor 108 is stored as suitable data structures (e.g., one or more lookup tables). In other embodiments, usage profile 106 may be implemented as an object that provides functions or methods operable within processor 108 to determine the historical usage of the printing device when needed by controller 102. For example, the object may access memories 110, 112, and 114 and analyze the data therein responsive to a request received through a method of the object provided to processes operating in processor 108. These and other implementation design choices will be readily apparent to those of ordinary skill in the art.

After determining the usage profile 106 based on the usage data (112) and optionally the device information (110) and schedule information (114), processor 108 utilizes the usage profile 106 to automatically switch printing engine 104 between the multiple energy consumption states available for the printing engine. In particular, usage profile 106 may identify high usage periods of time and low usage periods of time such that processor 108 may determine when the current time is nearing one of the high usage periods of time or nearing one of the low usage periods of time. When processor 108 determines that the current time is approaching, for example, a high usage period of time as indicated by the usage profile 106, processor 108 may commence the transition of printing engine 104 into the ready state such that any newly received document may be printed immediately upon receipt during the high usage period of time. By contrast, when processor 108 determines that the current time is approaching a low usage period of time as indicated by the usage profile 106, processor 108 may commence the transition of printing engine 104 into a low power state (e.g., a sleep mode or other low power energy consumption states).

Those of ordinary skill in the art will readily recognize that printing engine 104 may provide any number of energy consumption states with varying degrees of readiness to print. For example, in the context of electro-photographic (e.g., laser) printers, a heated fuser may be maintained at any of a variety of heated temperatures each corresponding with a different amount of time required to warm to a ready state capable of using printed sheets of paper.

The usage data stored in usage data memory 112 may comprise an array of entries where each entry stores the time of submission of a corresponding print job. Other parameters of a submitted print job may be stored in the corresponding entry such as the size of the print job, finishing devices required for the print job, elapsed time to complete the print job etc. Alternatively, usage memory 112 may be a database with date, time and corresponding job information. The database comprises sufficient information to generate the usage profile.

In operation of printing device 100, usage profile 106 may provide information regarding usage based on analysis of historical usage data stored in usage data memory 112. For example, a job ratio may be determined as the number of jobs submitted to the printing device 100 over the number of days of data collection (e.g., during a fixed predetermined data collection period or for all data acquired over any preceding data collection period of time). The job ratio may be determined for each of a plurality of time slots of a predetermined duration that together comprise a data collection period (e.g., multiple time slots per day for each of multiple days of the data collection period). Based on the usage data, processor 108 may compile an array of counters where each counter corresponds to one of the plurality time slots. Thus, the number of such time slot counters may be determined by the total duration of the data collection period divided by the duration of each time slot. During analysis of the usage data, the processor may increment the counter for the time slot corresponding to the time of submission of each print job found in the collected usage data. Following completion of the data collection, the ratio of the number of jobs submitted in each time slot per day, or per week, or per month, etc. may be computed and the determined ratio may be stored in a parallel array for each time slot. In alternative embodiments, the counter values may be stored in a database or may be generated as needed from raw job information stored in a database.

Figure 7:
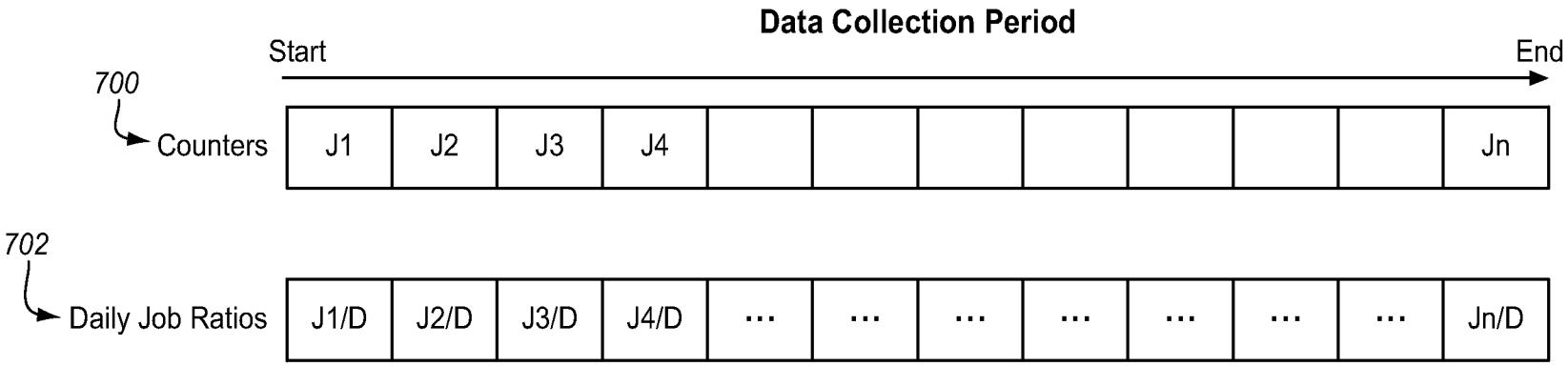
FIG. 7 is a block diagram of an array of counters and a corresponding array of computed job ratios for each of multiple corresponding time slots of acquired usage data.

FIG. 7 depicts such exemplary parallel arrays—a first array 700 representing the counters for each of a plurality of sequential time slots that comprise the data collection period and a second array 702 representing the corresponding ratios computed for each time slot as the number of jobs per day for each corresponding time slot. Those of ordinary skill in the art will readily recognize that the ratios may be computed for any granularity of time such as minutes, hours, days, weeks, months or even years. Multiple arrays may be used to accumulate counts and determine ratios over different granularities of time slots comprising the data collection period. Thus, job ratios may be determined for any combination of such periods of time in each time slot (e.g., Jobs per minute, jobs per hour, jobs per day, jobs per week, jobs per month, etc.). Any number of such ratios may be then used in combination for analysis to determine an appropriate energy consumption state for the printer engine 104 in each time slot.

Figure 8:
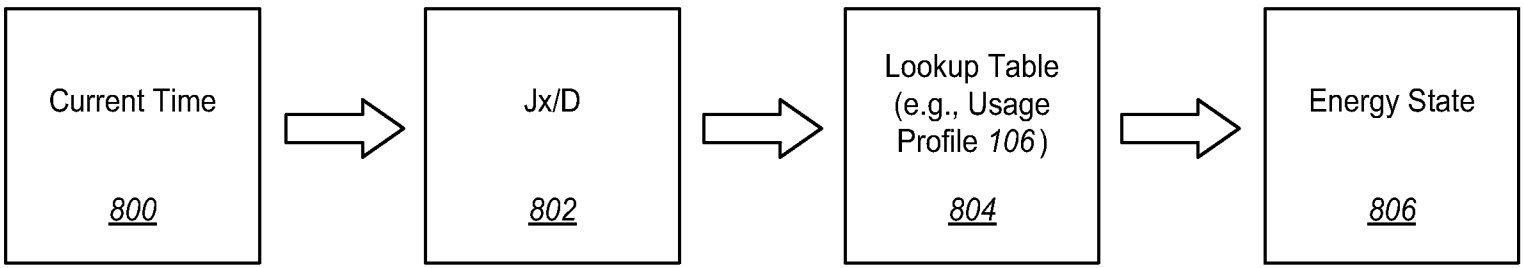
FIG. 8 is a block diagram describing exemplary processing of information to utilize a usage profile to determine a next energy state for a printing device in accordance with features and aspects hereof.

Thus, in one exemplary embodiment, usage profile 106 may be implemented as a simple lookup procedure (e.g., lookup table) such that for any given time slot encompassing the current time of day, the job ratio computed for that time slot may be matched with a corresponding energy consumption state for printing engine 104. FIG. 8 is a diagram generally representing processor 108 of printer controller 102 applying the usage profile 106. Given the current time 800, the job ratio for the corresponding time slot may be determined as ratio 802. Ratio 802 may then be applied to a lookup table 804 (e.g., a lookup table structure or process of usage profile 106) to determine a corresponding energy consumption state 806. The determined energy consumption state 806 for printing engine 104 is used by processor 108 to switch the printing engine 104 into the newly determined energy consumption state.

Figure 9:
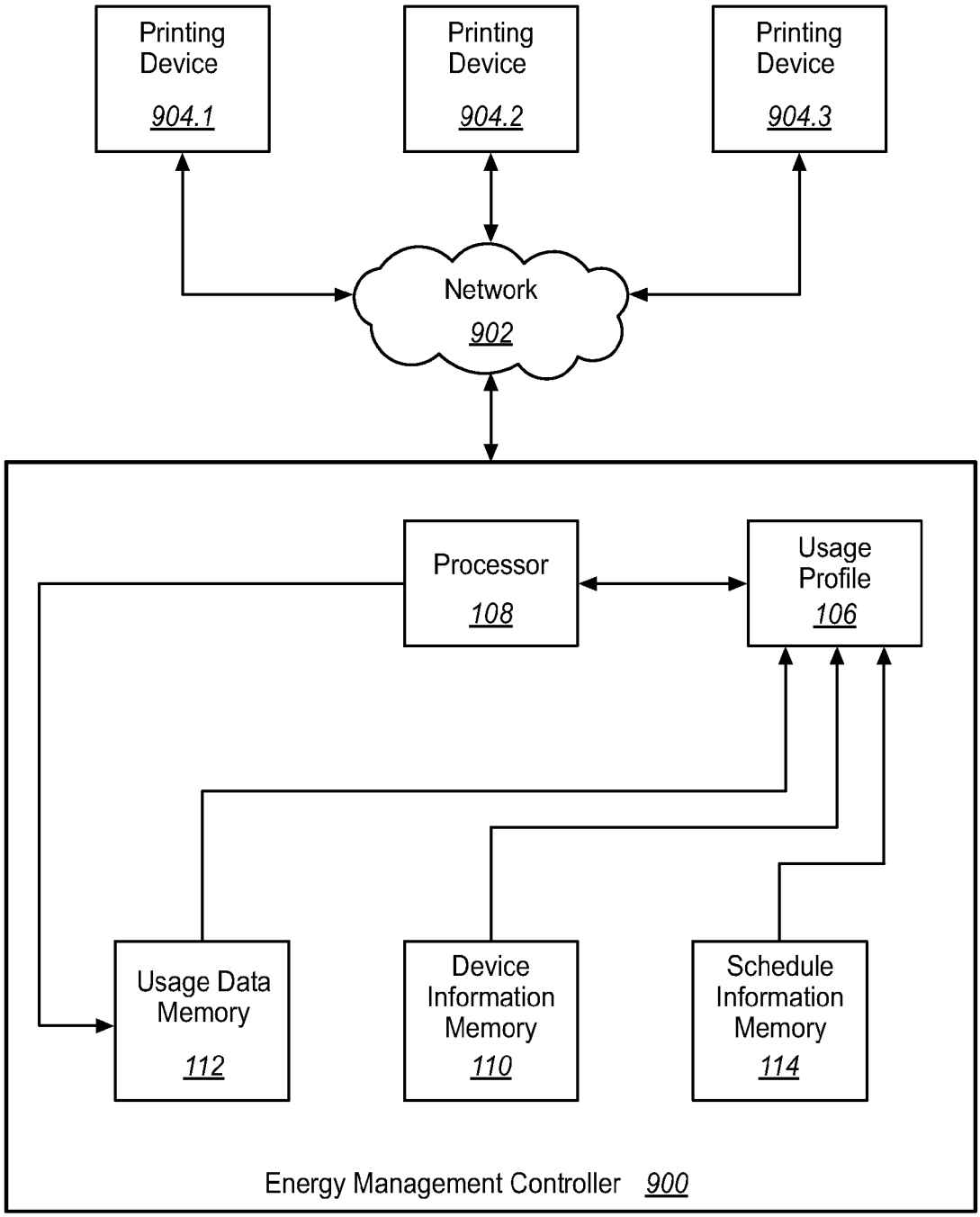
FIG. 9 is a block diagram of an exemplary system providing an energy management controller for enhanced energy management of one or more external printing devices for managing energy states of the printing devices based on a usage profile derived from previous usage data in accordance with features and aspects hereof.

FIG. 9 is a block diagram describing another exemplary embodiment wherein the enhanced energy management functions are provided by a controller (e.g., a computer system) external to the printing device (i.e., remote from one or more printing devices whose energy states are managed by the controller). Energy management controller 900 provides energy management functions similar to that of controller 102 above in FIG. 1 but may do so for any number of printing devices 904.1 through 904.3 coupled to the controller through a communication network 902. Controller 900 may be any suitable computing device or system adapted for coupling with one or more printing devices 904.1 through 904.3 and capable of performing the above energy management functions for any number of remote printing devices. Network 902 may be any suitable communication medium and corresponding protocol to provide communication connectivity between energy management controller 900 and the printing devices 904.1 through 904.3. Network 902 may be, for example, an Ethernet network, a wireless network (e.g., WIFI or Bluetooth), a USB communication hub, or any other suitable communication medium and protocol for coupling one or more printing devices with the external controller 900. Each printing device 904.1 through 904.3 may be any type of printing device having multiple energy consumption states including, for example, inkjet printing devices, electrophotographic printing devices, etc. Each printing device may be a stand-alone printer, a copier with printing capabilities, a multi-function device (e.g., MFP), or any other printing device having multiple energy consumption states.

Controller 900 comprises elements similar to those described above with respect to controller 102 of FIG. 1 for managing multiple energy consumption states for each of one or more printing devices. Processor 108 acquires usage data stored in usage data memory 112. A usage profile 106 is then determined as described above based on the acquired usage data in memory 112 and, optionally, also based on device information in memory 110 and schedule information in memory 114.

In one exemplary embodiment, the usage data may be acquired by processor 108 interacting with each of the printing devices 904.1 through 904.3. The interaction may entail querying each of the printing devices to determine the history of jobs submitted over a data collection period of time and/or may entail each printing device informing the controller 900 as each new print job is submitted during the data collection period of time. In other exemplary embodiments, the computing system that implements the energy management controller 900 functions may also include printer services features such that the system generates jobs to be sent to the printing devices and hence processor 108 may be informed as each new print job is generated and submitted to one of the printing devices 904.1 through 904.3. Thus, the energy management functions of controller 900 may be integrated with the print server functions. Since the controller 900 acquires usage data for multiple printing devices, printing device identification may be associated with the acquired data in usage data memory 112.

FIG. 2 is a flowchart describing an exemplary method in accordance with features and aspects hereof to automatically switch a printing device between multiple energy consumption states based on a usage profile. The method of FIG. 2 may be performed in a system such as printing device 100 and more specifically within printer controller 102 of FIG. 1. Further, the method of FIG. 2 may be performed within a remote energy management controller such as controller 900 of FIG. 9. Step 200 acquires usage data. In one embodiment, the usage data acquisition of step 200 may be performed continuously as a background processing task of the controller/system. In other exemplary embodiments, the acquisition of usage data may be for a fixed, predetermined period of time. Regardless of the duration of usage data acquisition, "data collection period of time" as used herein refers to whatever period of time usage data has been collected—whether continuous or for a predetermined fixed period of time. As noted above, acquisition or collection of the usage data may comprise storing information in a suitable memory regarding each print job submitted to the printing device. Various parameters of each submitted job may be gathered and stored in the usage data memory including, for example, start time (i.e., time of day) of the submitted job identification of the printing device where multiple printing devices are managed by the controller/system, etc. The data acquisition performed by step 200 may commence at installation or initialization of the printing device and/or at any desired point in time if the usage of the printing device may change over time.

At some point after some volume of usage data has been acquired (e.g., at the start of each day, week, month, etc.) step 202 determines a usage profile based on the acquired usage data. The usage profile identifies each of a plurality of time slots during the data collection period as either a high usage period of time or a low usage period of time. Each high usage period of time may be associated in the usage profile with a ready state of the printing device while each low usage period of time may be associated with a low-power state of the printing device. Those of ordinary skill in the art will readily recognize numerous additional degrees of usage may be identified each associated with a corresponding energy consumption state of the printing device. Step 204 is then iteratively operable while the printing device is functioning to switch to the printing device between the various energy consumption states based on the current time and the usage profile (e.g., the ready state and a low-power state and any other intermediate states identified in the usage profile). As generally outlined above with respect to FIG. 8, given the current time, a job ratio may be determined and matched to a corresponding energy consumption state in the usage profile.

FIG. 3 is a flowchart describing exemplary additional details of the processing of step 200 of FIG. 2 to acquire usage data. The data collection/acquisition processing of step 200 may increment counters for each of a plurality of time slots that comprise the data collection period. Based on the current time at each newly submitted job (i.e., the time of day at the submission of the print job), the counter of a corresponding time slot is incremented to indicate submission of another job during that time slot. Step 300 therefore initializes an array of counters. Steps 302 through 308 are then iteratively operable. As noted above, in various exemplary embodiments, the usage data acquisition may be continuous or may be for a fixed, predetermined period of time. Step 302 determines whether a new print job has been received. If so, step 304 stores parameters of the newly received print job in the usage data memory. As noted above, the stored parameters may include the current time of day when the new print job is received. Step 306 locates the job counter for the time slot corresponding to the current time. The located job counter is then incremented by step 308 and processing continues looping back to step 302. If step 302 does not detect receipt of a new print job, processing continues looping at step 302 to perform continuous usage data acquisition.

It will be noted by those of ordinary skill in the art that where the usage data acquisition is for a fixed period of time, the counter arrays used may be of a fixed size corresponding to the fixed duration of the usage data acquisition. Where usage data acquisition is continuous, the counters may be in a fixed size array that stores only the most recent period of time (i.e., a circular buffer). Still further, the usage data may simply be stored in a raw form such as in a database so that the counters may be computed as needed for any desired period of time that usage data has been collected and stored in the database.

Figure 4:
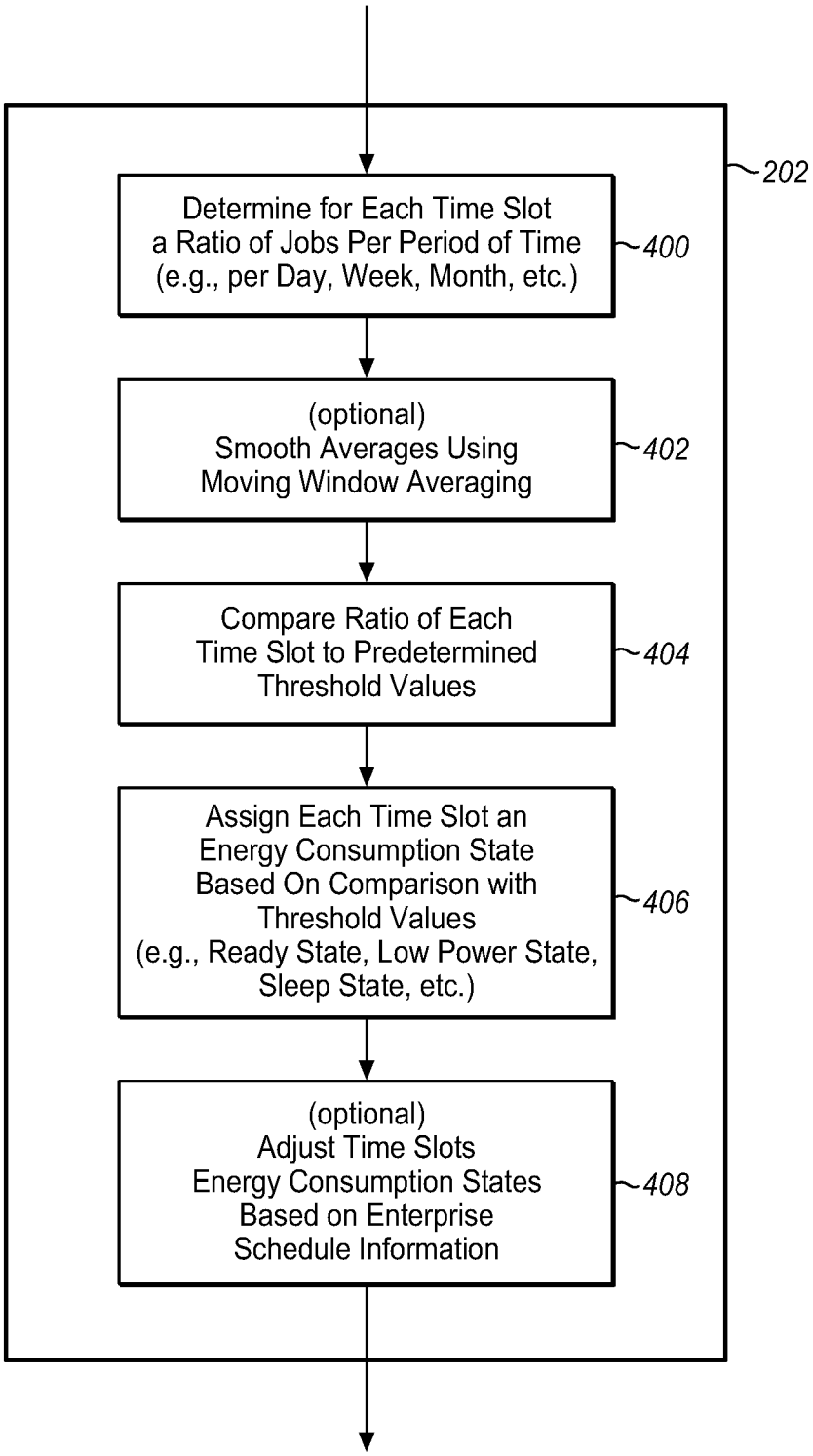

FIG. 4 is a flowchart describing exemplary additional details of the processing of step 202 to determine the usage profile based on the acquired usage data (e.g., the job counters array of job counters for the plurality of time slots that comprise the data collection period). Step 400 determines for each time slot a corresponding job ratio of the number of jobs per period of time (e.g., number of jobs per day for each time slot, number of jobs per week for each time slot, etc.). Step 402 optionally smoothes the computed job ratios utilizing statistical techniques such as a moving window average. Step 404 compares the job ratio of each time slot (optionally averaged using smoothing techniques of step 402) with each of one or more predetermined threshold values associated with the multiple energy consumption states of the printing engine. Each predetermined threshold value identifies a threshold job ratio to select between a corresponding lower energy consumption state and a corresponding higher energy consumption state. In one exemplary embodiment, a single predetermined threshold may be utilized to select between the ready state and the low-power state of the printing engine.

Step 406 associates an energy consumption state with each time slot based on the comparison performed by step 404. Step 408 optionally adjusts the energy consumption states associated with each time slot based on other provided information such as enterprise scheduling information etc. For example, though the data collection period used to generate the time slot based job ratios may have encompassed only workdays, enterprise scheduling information may identify particular days as vacation days, holidays, etc. Still further, enterprise scheduling information may identify certain hours known to be working hours or scheduled meetings etc. The scheduling information may therefore be utilized to adjust the energy consumption state associated with time slots to account for schedules of the enterprise in which the printing device is utilized.

Figure 5:
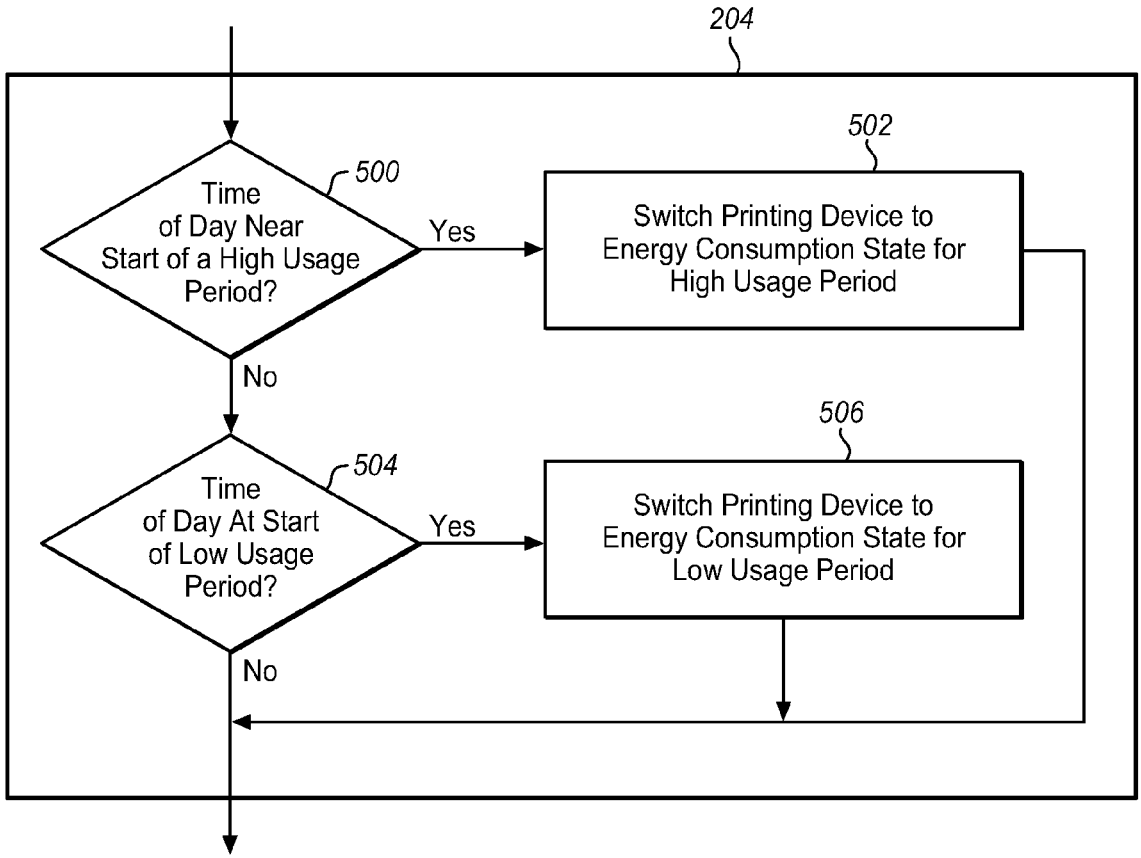

FIG. 5 is a flowchart describing exemplary additional details of one embodiment of the processing of step 204 to switch the printing device between multiple energy consumption states based on the usage profile. Step 500 determines whether the current time of day is nearing the start of a high usage period of time. As noted above, the current time of day will correspond to one of the plurality of time slots, each time slot associated with a corresponding energy consumption state if step 500. If step 500 determines that the current time of day is nearing a time slot that corresponds with a high usage period of time, step 502 switches the printing device to the energy consumption state for such a high usage period of time (e.g., the ready state in which they printing device is ready to process a received document immediately). If the current time of day is not nearing the start of a high usage period of time, step 504 determines whether the current time of day is at the start of a low usage period of time. If so, step 506 switches the printing device to a lower energy consumption state (e.g., the low-power state).

Figure 6:
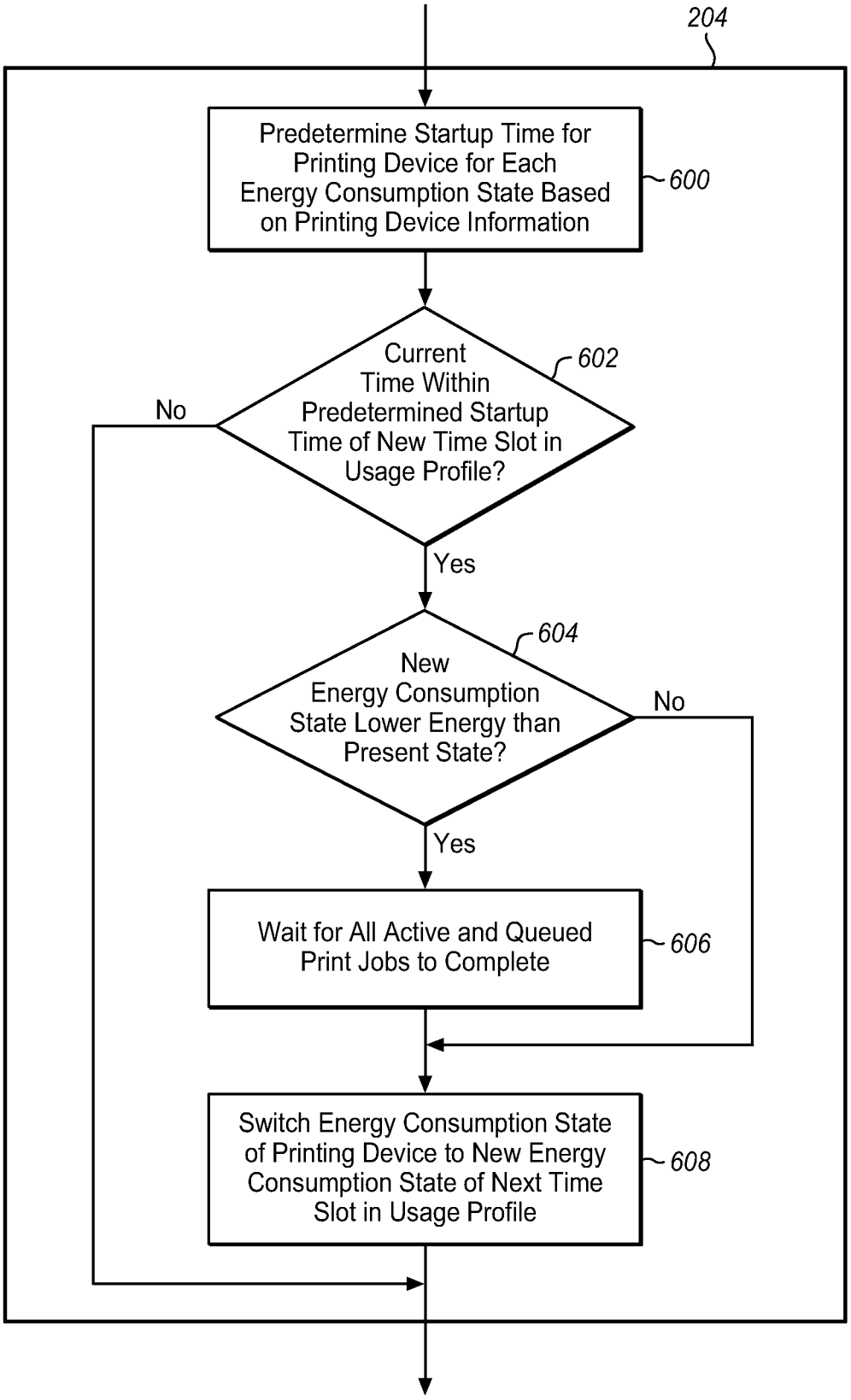

FIG. 6 is a flowchart providing exemplary additional details of another embodiment of the processing of step 204 to switch the printing device between multiple energy consumption states based on the usage profile. Step 600 determines a startup time for switching the printing device into a higher energy consumption state (e.g., a warm-up time required for the printing device to move into a ready state from a lower power consumption state). Step 602 determines whether the current time of day is within the predetermined startup time in advance of a next time slot defined in the usage profile. If not, processing of step 204 is completed and commences again on a next iteration as described in FIG. 2. If step 602 determines the current time is within the predetermined startup time, step 604 determines whether the new energy consumption state corresponding with the next time slot in the usage profile is a lower energy consumption state than the present energy consumption state of the printing device. If not, processing continues at step 608 to switch the energy consumption state of the printing device to the newly determined energy consumption state of the next time slot (as defined in the usage profile). If step 604 determines that the new energy consumption state is a lower energy consumption state than the present energy consumption state of the printing device, step 606 waits for all active and queued print jobs in the printing device to complete. When switching to a lower energy consumption state (e.g., from the ready state to a lower energy consumption state) all active jobs and queued jobs may be allowed to complete printing while the printing device remains in the ready state. After all active and queued print jobs are completed, processing continues with step 608 to switch the energy consumption state of the printing device to the lower energy consumption state corresponding to the next time slot in the usage profile.

Those of ordinary skill in the art will readily recognize numerous additional and equivalent steps in the method of FIGS. 2 through 6. Such additional and equivalent steps are omitted herein for simplicity and brevity of this discussion.

Figure 10:
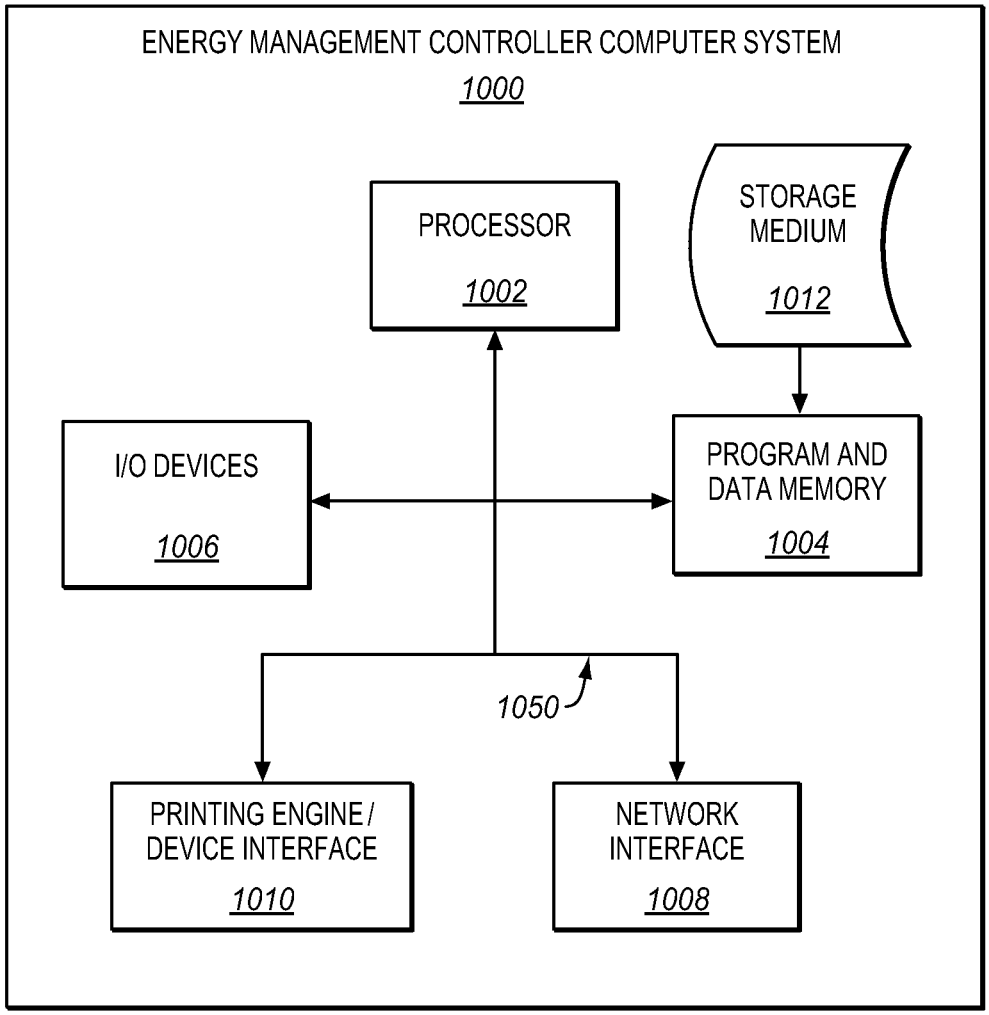
FIG. 10 is a block diagram of an energy management controller computing system on which a computer readable medium may be used to receive program instructions for a method to provide enhanced energy management of one or more printing devices.

Embodiments of the invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 10 is a block diagram of an exemplary energy management computer system 1000 adapted to provide enhanced energy management for printing devices in an embodiment.

Furthermore, embodiments of the invention can take the form of a computer program product accessible from a computer-usable or computer-readable medium 1012 providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid-state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

An energy management controller computer system 1000 suitable for storing and/or executing program code will include at least one processor 1002 coupled directly or indirectly to memory elements 1004 through a system bus 1050. The memory elements 1004 can include local memory employed during actual execution of the program code, bulk storage, and cache memories that provide temporary storage of at least some program code in order to reduce the number of times code must be retrieved from bulk storage during execution.

Input/output or I/O devices 1006 (including but not limited to keyboards, displays, pointing devices, etc) can be coupled to the system either directly or through intervening I/O controllers. Network adapter interfaces 1008 may also be coupled to the system to enable the energy management controller computer system 1000 to be coupled with other data processing systems or storage devices through intervening private or public networks. Modems, cable modems, IBM Channel attachments, SCSI, Fibre Channel, and Ethernet cards are just a few of the currently available types of network or host interface adapters. Printing engine/device interface 1010 may be coupled to the system to interface to one or more printing devices or engines for purposes of controller their respective energy states.

Although specific embodiments were described herein, the scope of the invention is not limited to those specific embodiments. The scope of the invention is defined by the following claims and any equivalents thereof.

We claim:

1. A method operable in a system for adjusting power consumption of the system, the method comprising:

acquiring usage data regarding a plurality of tasks initiated by the system over a period of time;

determining from the usage data a usage profile, the usage profile identifying one or more high usage periods of time and one or more low usage periods of time;

switching, based on the usage profile, the system between a ready state and a low power consumption mode.

2. The method of claim 1 wherein the step of switching to a ready state further comprises:

switching the system to a ready state a predetermined time in advance of an identified high usage period of time.

3. The method of claim 2 wherein the predetermined time is a sufficient time in advance of the high usage period of time such that the system is ready to commence processing of a new task immediately upon receipt of the new task.

4. The method of claim 1 further comprising acquiring at least one use policy for the system that indicates times when the system may be used; and determining the usage profile based on the usage data and the use policy.

5. A method operable in a system comprising a device and a controller for adjusting power consumption of the device, the device having multiple energy consumption states, the method operable in the controller and comprising:

acquiring usage data regarding a plurality of tasks initiated by the device over a period of time;

acquiring schedule information that indicates at least one item selected from the group comprising scheduled work days, scheduled work times, scheduled holidays, and use policies for the device indicating times that the device may be used;

determining a usage profile from the usage data and the schedule information, the usage profile identifying one or more high usage periods of time and one or more low usage periods of time; and switching the device between the multiple energy consumption states based on the usage profile.

6. The method of claim 5 wherein the step of acquiring usage data further comprises:

determining a number of tasks initiated by the device per time slot during each of a plurality of time slots during each of a plurality of days.

7. The method of claim 5 wherein the multiple energy consumption states include a ready state wherein the device is ready to initiate a task immediately and also include a low power state wherein the device is not ready to immediately initiate a task, wherein the step of switching further comprises:

switching, based on the usage profile, the device to the ready state prior to an identified high usage period of time such that the device is ready to process a new task upon receipt during the high usage period of time; and switching, based on the usage profile, the device to the low power state during an identified low usage period of time.

8. The method of claim 7 wherein the step of switching to the ready state further comprises:

switching the device to the ready state a predetermined time in advance of the identified high usage period of time.

9. The method of claim 8 wherein the predetermined time is a sufficient time in advance of the high usage period of time such that the device is ready to initiate a newly received task immediately upon receipt of the task.

10. The method of claim 8 further comprising:

receiving device information defining parameters of the operation of the device related to power consumption, wherein the step of switching the device to the ready state a predetermined time in advance further comprises:

determining the predetermined time based on the parameters defined in the device information.

11. The method of claim 5 wherein the step of switching the device between the multiple energy consumption states further comprises:

switching from a present energy consumption state to a new energy consumption state following completion of all tasks presently processing and/or queued to be processing in the device.

12. The method of claim 5 wherein the step of determining the usage profile further comprises:

identifying one or more low usage periods of time as periods of time in a use policy that prohibit use of the device by at least one user.

13. The method of claim 12 wherein the usage data comprises task parameters for each of a plurality of tasks initiated by the device, wherein the task parameters of a task comprise a time and date of the initiation of the task, and wherein the step of determining the usage profile further comprises:

determining, based on the task parameters of each of the plurality of tasks, a number of tasks initiated by the device over each of a plurality of predefined windows of time;

comparing the number of tasks in an identified predefined window of time with a predetermined threshold value;

identifying an identified window of time as a high usage period of time if the number of tasks in the identified predefined window of time is greater than the predetermined threshold value; and identifying an identified window of time as a low usage period of time if the number of tasks in the identified predefined window of time is less than the predetermined threshold value.

14. The method of claim 13 wherein the step of determining the number of tasks initiated during each window of time further comprises:

determining the number of tasks for each window of time as a moving average number of tasks over a plurality of windows of time chronologically before and/or after said each window of time.

15. A system comprising:

one or more devices each having multiple energy consumption states; and a controller coupled to the one or more devices wherein the controller is adapted to determine from previous usage data of the system one or more usage profiles where each usage profile corresponds to one of the one or more devices, each usage profile identifying one or more high usage periods of time for a corresponding device and identifying one or more low usage periods of time for a corresponding device, and wherein the controller is further adapted to switch each device between its multiple energy consumption states based on its corresponding usage profile.

16. The system of claim 15 wherein the controller comprises:

a memory adapted to store the previous usage data for each of the one or more devices, and wherein the controller is further adapted to acquire the usage data corresponding to each of the one or more devices and is further adapted to store the acquired usage data in the memory.

17. The system of claim 15 wherein the multiple energy consumption states include a ready state wherein the corresponding device is ready to initiate a task immediately and also include a low power state wherein the corresponding device is not ready to immediately initiate a task, wherein the controller comprises:

a memory adapted to store device information defining parameters of the operation of the one or more devices, the parameters relating to power consumption, wherein the controller is further adapted to switch the device to the ready state a predetermined time in advance of an identified high usage period of time in a corresponding usage profile, and wherein the controller is further adapted to determine the predetermined time based on the parameters defined in the device information.

18. The system of claim 15 wherein the controller comprises:

a memory adapted to store use policies that define one or more low usage periods of time wherein the use of a device by at least one user is prohibited, wherein the controller is further adapted to determine the usage profiles based on the usage data and based on the use policies.

19. The system of claim 15 comprising one device wherein the controller is integral with the device.

20. The system of claim 15 comprising a plurality of devices wherein the controller is remote with respect to one or more of the plurality of devices.

* * * * *